United States Patent [19]

Keller

[11] 4,188,736

[45] Feb. 19, 1980

[54] FOOTWEAR WITH SPECIALLY FORMED INSOLE

[75] Inventor: Joergen Keller, Vordingborg, Denmark

[73] Assignee: A/S Jac. Engelbredt, Vordingborg, Denmark

[21] Appl. No.: 882,089

[22] Filed: Mar. 1, 1978

[30] Foreign Application Priority Data

Apr. 3, 1977 [DK] Denmark ..... 951/77

[51] Int. Cl.[2] ..... A43B 23/28; A43B 13/38

[52] U.S. Cl. ..... 36/80; 36/43

[58] Field of Search ..... 36/80, 43, 44; 128/614, 128/615

[56] References Cited

U.S. PATENT DOCUMENTS

| | | | |
|---|---|---|---|
| 492,994 | 3/1893 | Sawyer | 36/43 |
| 1,738,929 | 12/1929 | Simon | 36/80 X |
| 2,045,844 | 6/1936 | Everston | 36/80 |
| 2,046,732 | 7/1936 | Fein | 36/43 |
| 2,083,581 | 6/1937 | Silver | 36/43 X |
| 2,210,332 | 8/1940 | Eich | 36/80 X |
| 2,460,493 | 2/1949 | Diamant | 36/80 X |
| 2,546,408 | 3/1951 | Riggs | 36/43 X |
| 4,079,526 | 3/1978 | Fukuoka | 36/44 |

FOREIGN PATENT DOCUMENTS

| | | | |
|---|---|---|---|
| 588504 | 12/1959 | Canada | 36/43 |
| 679842 | 9/1952 | United Kingdom | 36/80 |

*Primary Examiner*—James Kee Chi

*Attorney, Agent, or Firm*—Burgess, Ryan and Wayne

[57] ABSTRACT

The invention is a sole for footwear having an indentation for the ball of the heel and a heel stop under the rear of the arch to prevent the foot from sliding forward in the footwear.

1 Claim, 6 Drawing Figures

FOOTWEAR WITH SPECIALLY FORMED INSOLE

The invention relates to footwear with a sole formed in such a way that the form- and function demands made to an appropriate shoe are complied with to a previously unknown extent.

Footwear is known which is adapted to the various demands and functions of the foot. This may be a suitable elaboration of the inner contact surface of the sole accomplished by possibly combined with a special elaboration of the sole parts on the outer sole of the shoe. The designation of footwear adapted to the undeformed foot is natural-shaped footwear. However, the previously known footwear is not ideal for the foot.

It is the object of the invention to provide footwear of such form that the foot and the leg will not get tired and exposed to injurious stress during walking and standing.

SUMMARY OF THE INVENTION

According to the invention improved footwear is provided when the insole has an indentation for the ball of the heel in order to form a cup-shaped hollow which is in contact with the lower part of the heel, and when there is a small elevation under the rearmost part of the arch of the foot in order to form a heel stop which prevents the foot from sliding forward. This provides the toes with increased freedom of movement, as the foot is prevented from sliding forwards in the shoe, when the foot touches the ground and rolls inwards during a step. In this way a complete heel contact with the insole and a good weight distribution over the whole sole of the foot is achieved. The footwear according to the present invention are particularly useful for those who must stand up for long periods. Footwear according to the present invention reduces the risk of the foot falling into a valgus position in the ankle joint during standing. It is not a usual arch support, since the arch of the foot can move freely, because only the back third of the arch of the foot is supported. The sole is designed so that the big toe is bent not more or less inwards causing a reduced possibility of function for the outwards guiding muscle and the long flexor muscle of the big toe.

In making the insole even in the part between the cup-shaped hollow and the ball of the little toe, a complete contact surface between the foot and the insole is obtained, providing an even pressure on the foot, whereby callous skin, corns and blisters are avoided.

In using a yielding and workable support under the ball of the foot and toes, the forefoot has the possibility of achieving a greater contact surface, as it may sink down into the insole in a suitable depth. This means that the ball of the foot is not overloaded especially at the end of the step, where the toes are bent upwards, as the toes can always take part in the step by the stretching out of the toe bending muscles, and thereby take up part of the weight load. The spreading- and gripping reflex can freely activate the muscles of the foot, as the toes to some extent can seize the support and keep together the forefoot when necessary. When the support is workable this also means that the support can take form according to the shape of the foot of the user, i.e. can be adapted to the user. A small elevation will occur crosswise just behind the balls of the toe which together with the heel stop this will aid in preventing the foot from sliding forward in the shoe.

The outsole of the shoe does not have an artificial heel intendation or a minusheel, and therefore provides the most favourable function conditions when walking upwards as well as downwards. The leg can be swung forwards in a relaxed way in general in the phase of stepping forwards without any unnecessary bending of the knee- and especially the hip joint. Further the heel is rounded in the front and in the back, whereby the shoe is worn into shape from the start. Thus unnecessary wear on the outside of the heel is avoided, and wear distributed evenly over the whole outsole is achieved.

In elaborating the sole with a straight axis, the heel part of the shoe will guide the foot straight forward in the front part of the shoe, so that neither the big toe nor the little toe is squeezed.

Finally it is suitable, to make the sole from one piece of plastic. This provides a light and flexible as well as wear-proof sole which to the least possible extent prevents the strong upwards bending in the metatarsophalangeal joint of the toes. Thus a functional wringing of the foot is possible and also of the whole sole lengthwise at the end of the step.

The invention will be further described with reference to the drawings.

Figure 1:
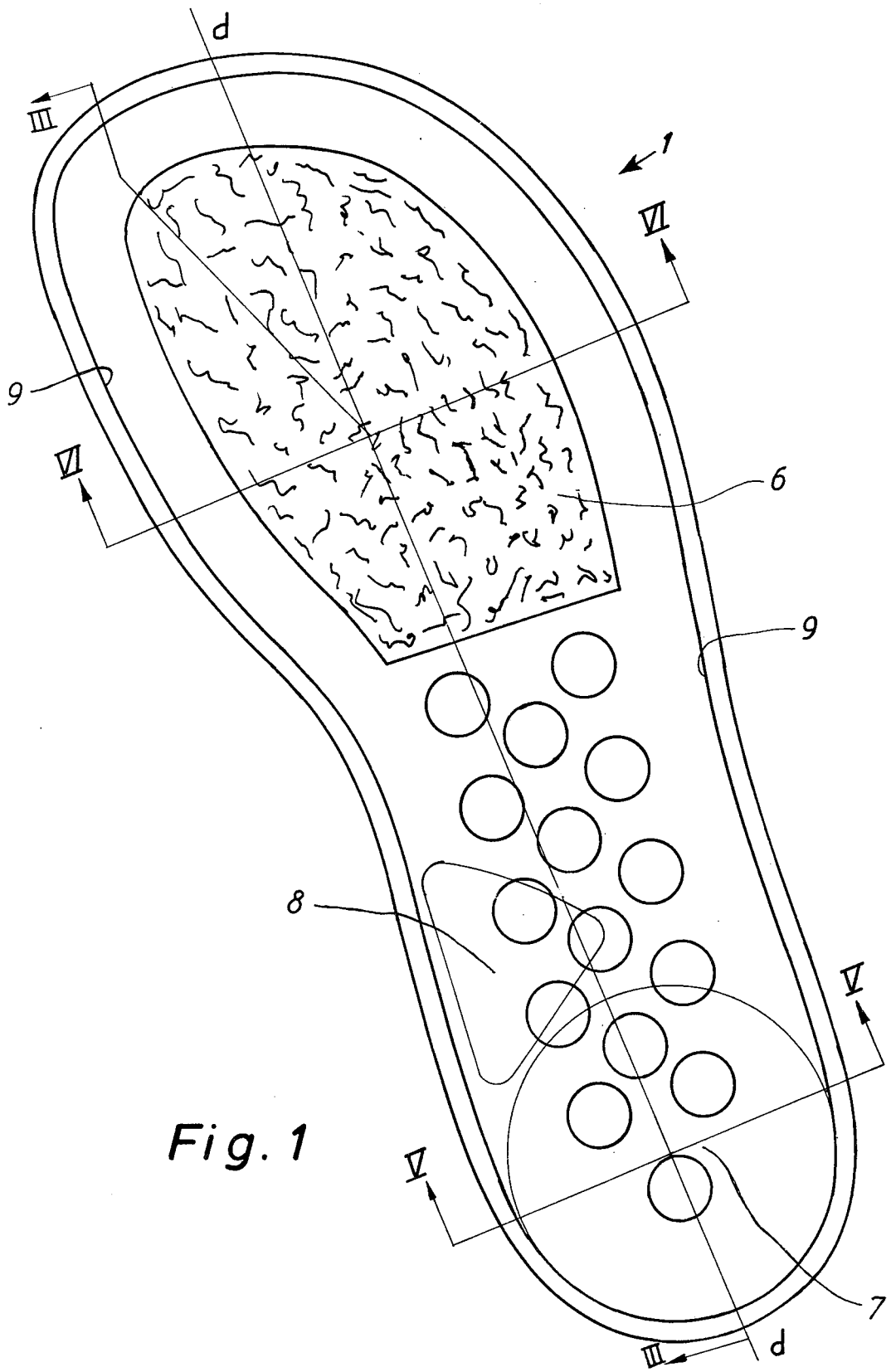
FIG. 1 is a view of the insole seen from above.
Figure 2:
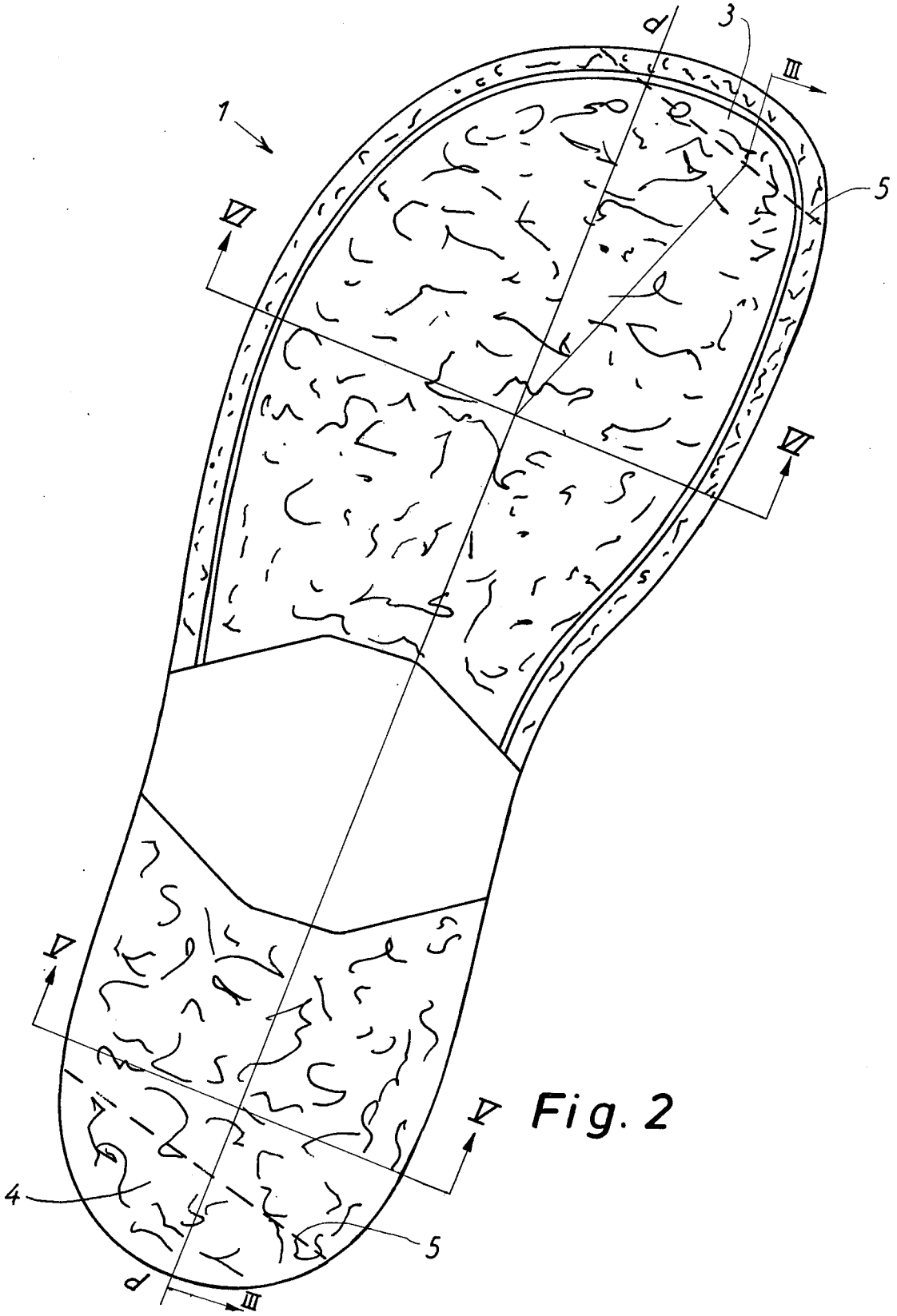
FIG. 2 is a view of the sole seen from the outsole.
Figure 3:
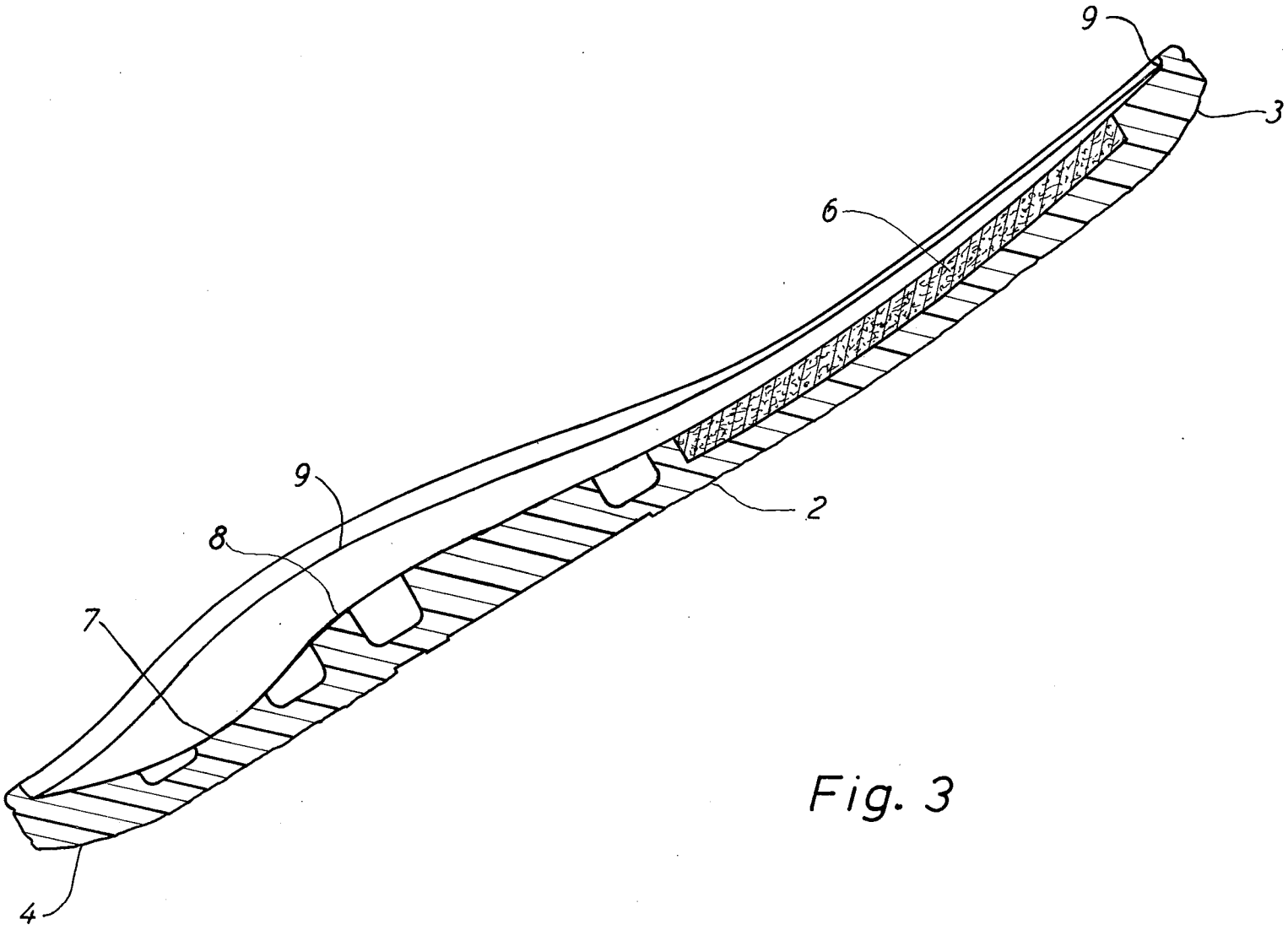
Figure 4:
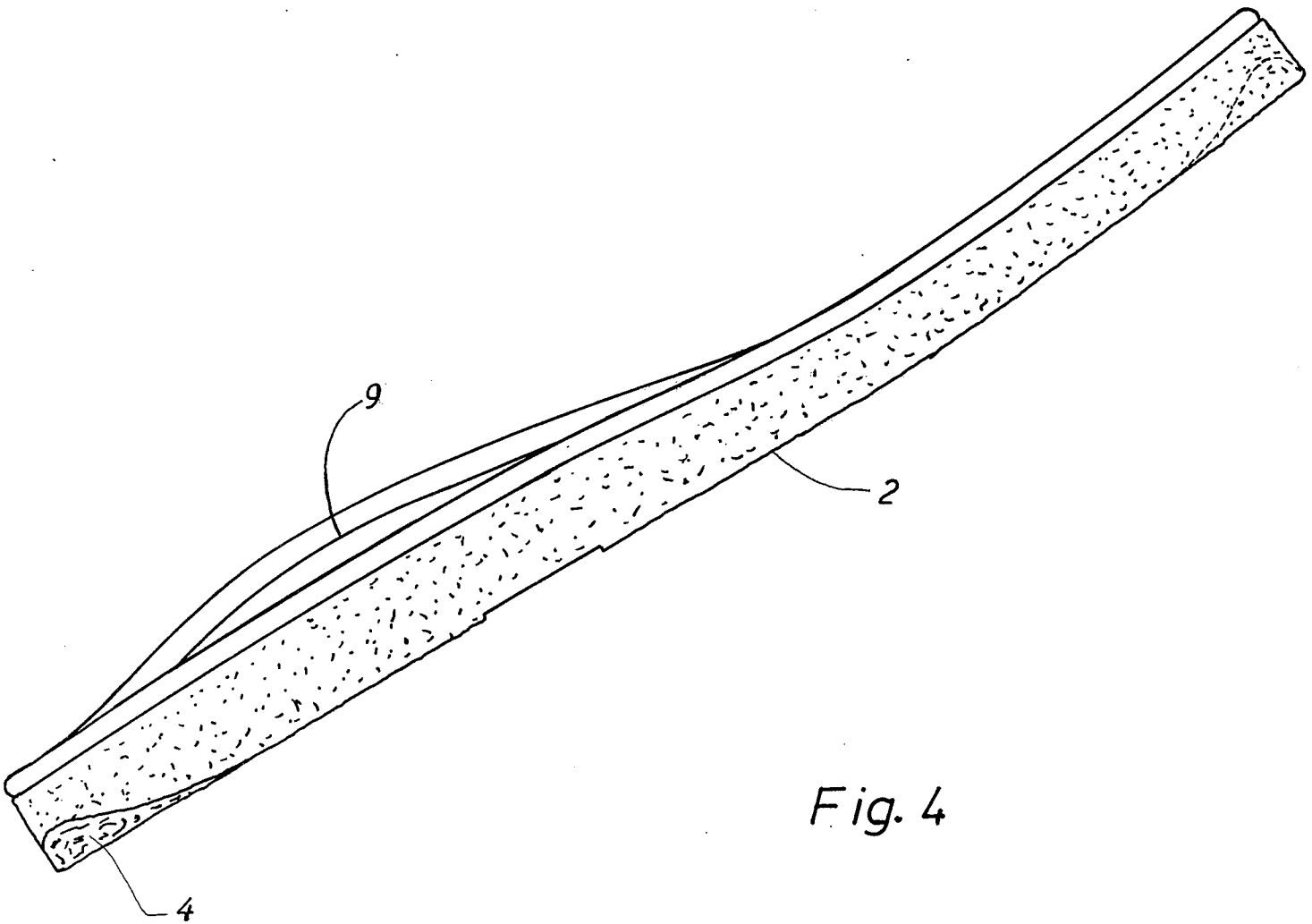
Figure 6:
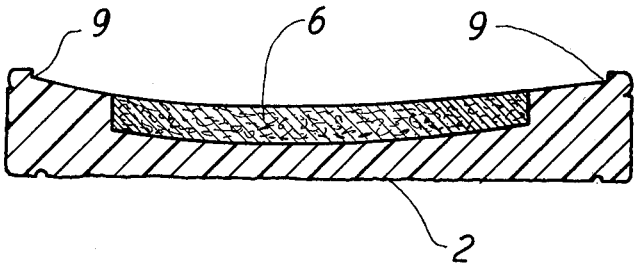
Figure 5:
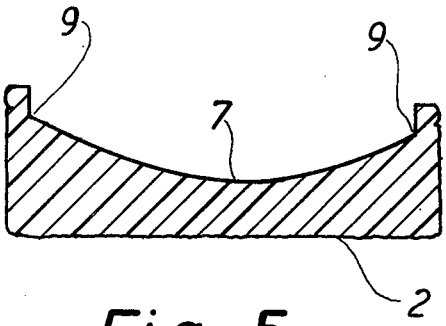

FIG. 3 is a sectional view of the sole from III—III in FIGS. 1 and 2, FIG. 4 is a view of the sole seen from the side, FIG. 5 is a sectional view of the sole from V—V in FIGS. 1 and 2 and FIG. 6 is a sectional view of the sole from VI—VI in FIGS. 1 and 2.

The drawing illustrates an embodiment of a sole 1 of a right shoe according to the invention, which sole has an outline as shown in FIGS. 1 and 2.

As shown in FIGS. 1 and 6 an intendation is placed in the area of the balls of the foot and toes, in which intendation a piece of yielding and workable material 6 is placed. A suitable yielding and workable material is a settled sheet of felt, the surface of which is on a level with the rest of the insole.

The yielding contact surface provides the previously mentioned advantages namely protection against overloading of the ball of the foot so the spreading-gripping reflex can freely activate the muscles of the foot. The risk of getting callous skin under the forefoot is reduced, and the contact surface is adapted individually to the foot after a short time so that an optimum even weight distribution and free function is achieved in each case.

The toes can work as described because the front part of the shoe has room enough for the toes to bend, and in addition the bones of the toes can lie in a straight extension of their metatarsal bones. This is achieved because the sole is fan-shaped at the front, as shown in FIGS. 1 and 2. A slight spreading of the toes is possible without bumping against the vertical front wall of the shoe at full load. Further, the front outline of the sole is softly rounded so that the shoe suits most foot types and not only the chamfered forefoot. Finally, there must be enough room upwardly for the toes with the largest height at the big toe, and there must be room for a slight upwards bending of the toes during the phase of stepping forward, as well as a slight curling when the foot is placed on the ground.

At the ball of the heel the insole is slightly cup-shaped as shown in FIGS. 3 and 5. The cup-shaped hollow 7 is formed directly in the insole, so that contact of the heel of the foot with the insole is optimum. The outline of the cup-shaped hollow 7 is indicated in FIG. 1 by a circle. Thus the body weight is distributed over the whole heel and the surface pressure will be the lowest possible. The sole is provided with a small elevation 8 under the rearmost third of the arch of the foot, the outline of this being indicated by a triangle in FIG. 1. The elevation 8 is not in the nature of an arch support, but a heel stop which prevents the foot from sliding forward in the shoe. When the shoe is further provided with suitable lacing, freedom of movement for the toes is achieved, as the rearmost part of the shoe fits so tightly to the foot that the metatarsus and the toes are given complete freedom of movement.

The welt section of the sole slopes downwards from the outermost edge 9 at the bead towards the internal of the sole as shown in FIGS. 3, 5 and 6. This contributes to keep the foot over the insole and thus maintain the foot in a correct position on the support surface.

The outsole 2 is in all essentials even with the exception of a minor upwards bending at the front and back of the shoe, namely where the direction of motion of the foot runs through the ball of the big toe and heel. The sole is without an artificial heel intendation. Hereby an effective tightening of the strong peronei is secured before the actual step, and thus a stretching of the ankle, as a beginning of the step of the foot.

As a whole the sole is formed with a straight axis, i.e. the sole does not curve. With a mounted upper part this means that the heel section of the shoe and the sole guides the forefoot straight forward in the front part of the shoe, so that neither the big toe nor the little toe is squeezed.

This elaboration with straight axis is in practice achieved in that the axis line of the foot, shown in FIGS. 1 and 2, called d—d, runs through the middle of the metatarsal bone of the second toe and through the centre of the cup-shaped hollow 7. This axis line d—d will divide the front part of the sole in the proportion 3:4 over the ball of the foot, in FIG. 1 in the cutting line VI—VI.

The sole is as anatomically correctly formed as practical to provide the foot as much freedom in its function as possible. The freedom of movement achieved is comparable to the freedom of movement which is felt, when walking without shoes.

In the heel part and the instep part of the insole some evenly distributed round recesses can be arranged in order to reduce the weight of the sole. The sole may be manufactured of any suitable material. A preferred material is polyurethane which provides a light and wearproof as well as suitably yielding sole.

The underside 2 of the sole 1 is in all essentials even with the exception of curved surfaces 3 and 4 below the ball of the big toe as well as below the ball of the heel, which surfaces 3 and 4 bend upwards from a generatrix 5 perpendicular to the direction of motion of the foot towards the outer edge of the sole. The sole 1 is formed with a straight axis in order to guide the foot from the cup-shaped hollow 7 straight forwards in a line d—d through the metatarsal bone of the second toe.

I claim:

1. Footwear having an upper portion and a sole comprising an insole having an indentation for contact with the ball of the heel of the foot and a heel stop comprising a small elevation in front of the indentation and at a location to be under the rear portion of the internal part of the arch when said footwear is positioned on a foot, the surface of said insole being substantially level between the indentation for contact with the heel and the location of the ball of the little toe whereby the foot is prevented from sliding forward in said footwear, said insole being provided with a yielding and workable support at the location of the ball of the foot and toes, said support being level with the rest of the insole, the outside surface of the sole below the ball of the big toe and the ball of the heel being curved upwardly from a generatrix perpendicular to the direction of motion of the foot toward the edge of the sole, said sole being formed with a straight axis which passes through the center of the indentation for contact with the ball of the heel through the location of the metatarsal bone of the second toe.

* * * * *

UNITED STATES PATENT OFFICE
CERTIFICATE OF CORRECTION

Patent No. 4,188,736 Dated February 19, 1980

Inventor(s) Joergen Keller

It is certified that error appears in the above-identified patent and that said Letters Patent are hereby corrected as shown below:

Column 1, lines 10-13, the sentence beginning with "This may be..." should read as follows: --This may be accomplished by a suitable elaboration of the inner contact surface of the sole possibly combined with a special elaboration of the sole parts on the outer sole of the shoe."

line 42: "bent not" should be --not bent--.

Column 2, lines 2, 39, 40-41 and Column 3, line 29: "intendation" should be --indentation--.

Signed and Sealed this

*Twenty-eighth* Day of *October 1980*

[SEAL]

*Attest:*

SIDNEY A. DIAMOND

*Attesting Officer*

*Commissioner of Patents and Trademarks*